United States Patent [19]

Bommaraju et al.

[11] Patent Number: 4,470,890

[45] Date of Patent: Sep. 11, 1984

[54] METHOD FOR PREVENTING CATHODE CORROSION

[75] Inventors: Tilak V. Bommaraju, Grand Island; Krishnan Viswanathan, Niagara Falls, both of N.Y.

[73] Assignee: Occidental Chemical Corporation, Niagara Falls, N.Y.

[21] Appl. No.: 332,907

[22] Filed: Dec. 21, 1981

[51] Int. Cl.[3] ..... C25B 1/16; C23F 11/18

[52] U.S. Cl. ..... 204/98; 204/1 R; 422/13; 422/18

[58] Field of Search ..... 204/1 R, 95, 98; 422/7, 422/13, 18

[56] References Cited

U.S. PATENT DOCUMENTS

| | | | |
|---|---|---|---|
| Re. 30,864 | 2/1982 | Justice et al. | 204/98 |
| 370,583 | 9/1887 | Williams | 422/18 |
| 2,433,601 | 12/1947 | Comstock | 423/186 |
| 2,454,258 | 11/1948 | Schroeder et al. | 422/18 |
| 2,902,418 | 9/1959 | Burns | 204/98 |
| 2,961,292 | 11/1960 | Pickett et al. | 422/18 |
| 3,535,216 | 10/1970 | Grotheer et al. | 204/95 |
| 3,770,652 | 11/1973 | Gordon | 422/18 |
| 3,835,001 | 9/1974 | O'Brien | 204/95 |
| 4,004,988 | 1/1977 | Mollard et al. | 204/90 |
| 4,358,353 | 11/1982 | Bommaraju et al. | 204/98 |

OTHER PUBLICATIONS

Uhlig, "Corrosion & Corrosion Control", 1963, pp. 224–232.

*Primary Examiner*—T. Tung

*Attorney, Agent, or Firm*—James F. Tao; William G. Gosz

[57] ABSTRACT

A method is provided for preventing the dissolution of transition metal-based cathodes used in chlor-alkali diaphragm cells by adding a small amount of a corrosion inhibitor, such as sodium silicate or trisodium phosphate, to the electrolytic solution during periods of interrupted current flow to the cell. The corrosion inhibitor is adsorbed on the surface of the cathode and forms an adherent protective film on the cathode. This film protects the cathode by preventing dissolution of the transition metal in the cathode coating due to oxidation by sodium hypochlorite.

3 Claims, No Drawings

METHOD FOR PREVENTING CATHODE CORROSION

BACKGROUND OF THE INVENTION

The present invention relates to a method for preventing the corrosion of transition metal-based cathodes used in electrolytic diaphragm-type cells. Such cathodes are advantageous due to their ease and low cost of fabrication and their low overvoltage characteristics when used, for example, in the electrolysis of aqueous solutions of alkali metal halides to produce alkali metal hydroxides and halogens.

A typical electrolytic alkali metal halide cell is an enclosed container which is physically partitioned into at least two distinct regions or chambers by means of a permeable intermediate barrier or cell separator, such as an asbestos diaphragm or synthetic microporour separator. During the electrolysis of an alkali metal halide solution, hydrogen and alkali metal hydroxide are formed at the cathode while chlorine and oxygen are formed at the anode. When the alkali metal is sodium, the electrolytic solution in the cathode compartment, i.e. the catholyte, may contain approximately 12%–17% NaOH, 15%–20% NaCl, and negligible, e.g. about 10 p.p.m., NaOCl. Under conditions of normal operation, sodium hypochlorite will generally not cause deterioration of the cathode coating material. However, when the current flow to the cell is interrupted, such as when the cell is subjected to routine maintenance during a shutdown period, the concentration of sodium hypochlorite in the catholyte increases significantly to amounts of up to 2 gms./liter or more. Such concentrations of sodium hypochlorite can have an immediate adverse effect on the transition metals contained in the cathode, causing such metals to dissolve in the solution and ultimately leading to the failure of the cathode coating. "Transition metal", in the context of the present invention, includes iron, cobalt, nickel, their oxides and combinations of alloys thereof.

The rapid increase in sodium hypochlorite concentration in the catholyte during periods of current interruption is caused by the convective flow and diffusion of hypochlorite ions from the anolyte. At the cathode, the sodium hypochlorite is reduced to sodium chloride and water as follows:

$$NaOCl + 2H^+ + 2e^- \rightarrow NaCl + H_2O \quad (1)$$

The corresponding oxidation of the cathode transition metal, illustrated below by nickel, can be designated as follows:

$$Ni \rightarrow Ni^{++} + 2e^- \quad (2)$$

The overall reaction can thus be designated as:

$$Ni + NaOCl + 2H^+ \rightarrow Ni^{++} + NaCl + H_2O \quad (3)$$

The nickel in the cathode is thus ionized and becomes soluble in the catholyte causing dissolution of the coating.

In recent years, increasing attention has been directed toward improving the hydrogen overvoltage characteristics of electrolytic cell cathodes. In addition to having a reduced hydrogen overvoltage, a cathode should also be constructed from materials that are inexpensive, easy to fabricate, mechanically strong, and capable of withstanding the environmental conditions of the electrolytic cell. Iron or steel fulfills many of these requirements, and has been the traditional material used commercially for cathode fabrication in the chlor-alkali industry. However, since steel cathodes generally exhibit overvoltage in the range of from about 300 to 500 millivolts under typical cell operating conditions, i.e. at a temperature of about 90° C. and a current density of from 100 to 200 milliamperes per square centimeter, efforts have focused on improved cathode coatings having significantly reduced hydrogen overvoltage.

Various coating materials have been suggested to improve the hydrogen overvoltage characteristics of electrolytic cell cathodes in an economically viable manner. A significant number of the prior art coatings have included transition metals other than iron or steel, such as cobalt and nickel, or mixtures, alloys or intermetallic compounds of these metals with various other metals. Frequently, when nickel is employed in admixture with another metal or compound, the second metal or compound can be leached or extracted in a solution of, for example, sodium hydroxide, to provide high surface area coatings, such as Raney nickel coatings.

Copending application Ser. No. 104,235, filed Dec. 17, 1979, discloses a low hydrogen overvoltage cathode having an active surface layer comprising, as preferred embodiment thereof, a codeposit of nickel, molybdenum or an oxide thereof, and cadmium. Other transition metal-based cathode coatings are disclosed in U.S. Pat. No. 4,105,532, issued Aug. 8, 1978, and U.S. Pat. No. 4,152,240, issued May 1, 1979, which relate to cathodes comprising, respectively, alloys of nickel-molybdenum-vanadium and nickel-molybdenum using specially selected substrate and intermediate coatings of copper and/or dendritic copper. Similar coatings are also enclosed in U.S. Pat. Nos. 4,033,837 and 3,291,714.

Copending application Ser. No. 149,814, filed May 14, 1980, now U.S. Pat. No. 4,295,951 discloses a film-coated cathode useful in alkali metal halate cells. The film-forming material is a permanent coating which serves to eliminate the need for chromate additives to the cell whle providing a high operating efficiency.

U.S. Pat. No. 4,055,476, issued Oct. 24, 1977, discloses the continuous addition of nickel-based catalysts to an electrolytic diaphragm cell brine feed to prevent the formation of chlorates in the cell by decomposing sodium hypochlorite. Other reagents which are disclosed as being useful for this purpose include hydrochloric acid, sodium tetrasulfide, and various nickel and cobalt compounds. However, this patent does not recognize the utility of any of the above-mentioned materials for the prevention of cathode dissolution during periods of current interruption or cell shutdown.

Under typical commercial operating conditions of the chloralkali industry, it is not unusual for the operator of the cell to experience periods of interrupted current as frequently as once a month or more. The frequency of such shutdown periods thus poses a serious problem to the durability and maintenance of transition metal-based cathodes used in commercial cells. It will therefore be readily appreciated that a need exists for protecting such cathodes against the corrosive effects of sodium hypochlorite during shutdown periods.

SUMMARY OF THE INVENTION

In accordance with the present invention, there is provided a method for preventing the corrosion of transition metal-based cathodes used in chlor-alkali diaphragm cells due to attack by sodium hypochlorite which is present in the catholyte during shutdown periods. This is accomplished by introducing an effective amount of a suitable corrosion inhibitor, such as sodium silicate, trisodium phosphate, or mixtures thereof, to the catholyte during or preceding periods of interrupted current flow to the cell. Preferably, the corrosion inhibitor is added in an amount sufficient to establish a concentration of generally from about 1 to about 10 milligrams/liter of catholyte solution in the cell. The corrosion inhibitor is adsorbed on the surface of the cathode and forms an adherent protective film on the cathode.

DETAILED DESCRIPTION OF THE INVENTION

The objects of the present invention are achieved by the addition of an effective amount of a corrosion inhibitor to the catholyte of the cell during or preceding periods of interrupted current flow to the cell. Suitable corrosion inhibitors for purposes of this invention include sodium silicate, trisodium phosphate, or mixtures thereof.

In practice, the amount of corrosion inhibitor generally required corresponds to a catholyte solution concentration of from about 1 to about 10 milligrams/liter. Amounts of corrosion inhibitor in the catholyte of less than about 1 milligram/liter are generally not sufficient to form an adherent film on the cathode surface which will adequately protect the transition metal in the cathode from the corrosive effects of sodium hypochlorite present during shutdown periods. Amounts of corrosion inhibitor in excess of about 10 milligrams/liter of catholyte solution are also disadvantageous, since such excessive amounts will form a relatively thick film on the cathode surface. Since the film-forming material is electrically nonconductive, a relatively thick film would reduce the current efficiency of the cell by decreasing the flow of electrical current through the cathode. Ideally, the concentration of corrosion inhibitor in the catholyte will be just sufficient to form a thin, adherent film on the cathode surface or from about 0.005 m.m. to about 0.05 m.m. in thickness with a uniform porosity in the range of from about 40% to about 60%. Based on the concentration of the corrosion inhibitor present in the catholyte, the actual quantity of corrosion inhibitor which should be added to the catholyte can be readily ascertained based on the solution capacity of the cathode component.

In order to minimize the quantity of corrosion inhibitor which must be added to the catholyte, such addition is suitably accomplished immediately preceding the shutdown period. Upon addition of the corrosion inhibitor to the catholyte, a film of the required thickness is formed on the cathode surface within a relatively short time, i.e. on the order of a few minutes, depending on the rate of addition of the corrosion inhibitor to the catholyte and the current density impressed on the cathode. Once formed, such a film can be reasonably expected to last for as long as several months under typical chlor-alkali cell operating conditions. Thus, since shutdown periods generally occur as frequently as once a month, it may not be neccesary to add the corrosion inhibitor preceding or during every shutdown period.

The addition of the corrosion inhibitor to the cell can be accomplished using either a batch or continuous procedure. A variety of automated process equipment can be advantageously employed to effect the addition of the reducing agent to the cell solution. Such equipment is standard in the industry, and is familiar to those skilled in the art.

The present invention is readily application to a variety of commercial-scale chlor-alkali cells, such as the Hooker 2A series of diaphragm cells. Commercial cells of this type are generally provided with a series of dimensionally stable anodes and steel or iron cathodes, with porous, asbestos diaphragms deposited on the cathode screen. Continuous means for supplying and removing chemicals to the cells are also provided. In more advanced cell designs, the use of improved energy-saving components, such as plastic reinforced asbestos diaphragms, synthetic microporous separators, and transition-metal cathodes is becoming increasingly widespread in the chlor-alkali industry. This invention is especially useful in cells employing these advanced components since the corrosion inhibitor does not consume additional electrical energy upon introduction to the cell and does not otherwise adversely affect the performance of the cell or cell components.

The following example further illustrates and describes the various aspects of the invention, but is not intended to limit it. Various modifications can be made in the invention without departing from the spirit and scope thereof, as will be readily appreciated by those skilled in the art. Such modifications and variations are considered to be within the purview and scope of the appended claims.

EXAMPLE

A Hooker H-4/9 chlor-alkali diaphragm cell having an electrolyte comprising 15% sodium hydroxide and 17% sodium chloride is operated with a dimensionally stable anode and an iron cathode at a current density of 1.5 ASI. Sufficient sodium silicate is fed to the cathode compartment with $N_2$ purging and allowed to mix with the catholyte until a concentration of 5 milligrams/liter is established. The current is then turned off. The cell is disassembled, the cathode is removed and visually inspected. A thin, uniform film is found adhering to the cathode surface, but no physical damage or visible signs of deterioration of the cathode coating are observed.

What is claimed is:

1. A method for inhibiting the dissolution of nickel-containing cathodes for use in electrolytic chlor-alkali cells comprising adding sodium silicate to the catholyte of said cell during or preceding periods of interrupted current flow to the cell, wherein the sodium silicate is present in the catholyte in a concentration range of from about 1 to about 10 milligrams/liter.

2. The method of claim 1 wherein the cathodes are predominantly nickel.

3. The method of claim 1 wherein the corrosion inhibitor forms a uniform film having an average thickness of from about 0.005 m.m. to about 0.05 m.m. on the cathode surface .

* * * * *